US006047676A

United States Patent [19]

Trapy

[11] Patent Number: 6,047,676

[45] **Date of Patent: *Apr. 11, 2000**

[54] METHOD AND DEVICE FOR ASSISTING COLD STARTING OF AUTOMOBILES

[75] Inventor: Jean Trapy, Rueil-Malmaison, France

[73] Assignee: Institut Francais du Petrole, Rueil Malmaison, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/751,734

[22] Filed: Nov. 18, 1996

[30] Foreign Application Priority Data

Nov. 23, 1995 [FR] France ..... 95 14062

[51] Int. Cl.[7] ..... F02N 17/047

[52] U.S. Cl. ..... 123/142.5 R

[58] Field of Search ..... 123/142.5 R

[56] References Cited

U.S. PATENT DOCUMENTS

| | | | |
|---|---|---|---|
| 3,732,796 | 5/1973 | Masaki | 60/284 |
| 4,448,157 | 5/1984 | Eckstein et al. | 123/142.5 R |
| 4,506,505 | 3/1985 | Melzer | 123/142.5 R |
| 4,513,911 | 4/1985 | Sanchez | 123/142.5 R |
| 4,685,292 | 8/1987 | Brigham et al. | 60/320 |
| 4,685,430 | 8/1987 | Ap | 60/320 |
| 4,777,796 | 10/1988 | McEachern, Jr. | 60/320 |
| 4,781,242 | 11/1988 | Meijer et al. | 60/320 |
| 5,048,752 | 9/1991 | Hintennach et al. | 123/142.5 R |
| 5,192,021 | 3/1993 | Meier et al. . | |
| 5,205,250 | 4/1993 | Easterly et al. | 123/142.5 R |
| 5,265,418 | 11/1993 | Smith | 123/142.5 R |

FOREIGN PATENT DOCUMENTS

| | | |
|---|---|---|
| 3914834 | 8/1990 | Germany . |
| 41 39 600 | 6/1993 | Germany . |
| 42 08 621 | 9/1993 | Germany . |

*Primary Examiner*—Erick R. Solis

*Attorney, Agent, or Firm*—Antonelli, Terry, Stout & Kraus, LLP

[57] ABSTRACT

A device and method for assisting cold start of automobiles with internal combustion engines which include a cooling circuit and an exhaust line with a catalyst. The method includes use of at least one burner and a means for recovering the calories produced by the burner, where the calories recovered are restored to at least one of the following elements: the intake air, the walls of the engine itself, the internal cooling circuit of the engine, or the passenger compartment heating means. A burner is used directly to heat a gas-liquid exchanger built into cooling circuit of engine, as well as the engine exhaust gases. The intake air and vehicle passenger compartment thus benefit from the improved heating of the cooling circuit.

17 Claims, 1 Drawing Sheet

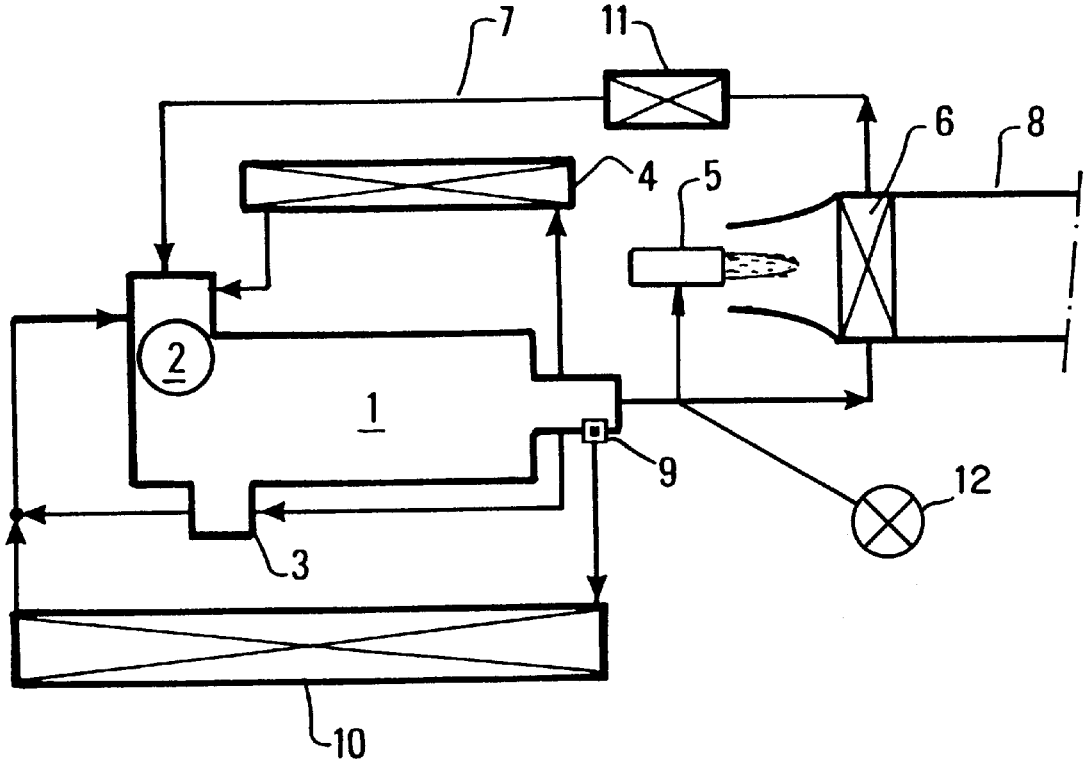
7
11
6
8
4
5
2
1
9
12
3
10

METHOD AND DEVICE FOR ASSISTING COLD STARTING OF AUTOMOBILES

FIELD OF THE INVENTION

The present invention relates to cold starting of automobiles with internal combustion engines.

BACKGROUND OF THE INVENTION

Due to the increasing strictness of current or future standards, pollutant emissions must be reduced, particularly during cold starting, in the first minutes in which the engine is running. It is known that most pollutants (80%) are released during this time, when the conversion catalyst located in the exhaust line has not yet been sufficiently heated by the exhaust gases to be effective.

It is now only too well known that one of the major obstacles to cleanup of automobiles occurs during the temperature rise phase following a cold start.

There are several reasons for this, of which the most important is the enormous increase in the viscosity of lubricants when cold, which may exceed 1000 cSt below 0° C. resulting in very high friction levels in the engine, bringing about equally high consumption levels. This is aggravated by the difficulties with supply at low temperatures, and the poor quality of the carbon-containing mixtures arising from inadequate atomization and evaporation of the fuel in the intake air, which is compensated, albeit inadequately, by enriching the air/fuel mix. Overconsumption is of course accompanied by high emissions of basic pollutants, carbon monoxide, and unburnt compounds, resulting from overly-rich mixtures and incomplete combustion, which the exhaust catalyst cannot eliminate until its activation temperature is reached, which takes several minutes.

Moreover, improvements in the design of combustion chambers have brought about a real increase in thermodynamic efficiency in recent engines, so that less heat is transferred through the cylinder walls and hence a further difficulty in heating the engine, and thus the passenger compartment of the vehicle, by exploiting the heat contained in the coolant in a natural manner.

Numerous studies have been directed at the problem of cold starts in automobiles. The solutions are essentially of two types: those outside the engine and those directly involving the engine.

Solutions involving the engine include for example pre-evaporation of fuel, improving atomization of the fuel, or homogenizing the incoming fuel. As an example, patent FR 2,706,184 describes such a fuel vaporization device.

Solutions "outside" the engine relate in particular to the exhaust line, specifically reducing the time necessary to activate the catalyst or catalysts located in the exhaust.

A known method is to recover the catalyst from a layer designed to reduce the temperature at which the catalyst begins to become active.

Another solution may be to inject additional air upstream of the catalyst, which thus receives additional energy and heats more rapidly.

Electrical heating of the catalyst may also be considered as for example in patent EP-B1-605479. This solution is indeed effective because it is totally focused on the catalytic muffler. However, this system is an energy consumer because it consumes a minimum of three or four kilowatts from the battery. Thus an additional battery must be provided. The energy balance is incompletely satisfactory and the overall efficiency is very low.

Thus, recent developments have endeavored to reduce the electrical capacity required for heating the catalyst.

The solutions in this direction consist of choosing an appropriate catalytic element and placing it in the right spot.

Other technological solutions have been considered, such as preheating the catalytic muffler with hot gases generated by a burner located upstream of said muffler. Patent WO 95/14852 describes an arrangement of this type. The heating power of such a unit is high: approximately 15 kW, so that the catalyst can be activated in approximately twenty seconds. The advantage is the efficiency of this system: approximately 100%.

However, one of the problems of this type of solution is that it requires a burner whose sole function is to heat the catalyst or catalysts.

In addition, both for electrical heating and burner heating, a problem of premature and/or unpredictable catalyst aging may arise due to the sharp heat stresses placed on the catalyst.

The present invention remedies in particular the problems of the prior art listed above.

SUMMARY OF THE INVENTION

Thus, the present invention relates to a method for improving both consumption and pollution control of engines under cold conditions.

One of the advantages of the present invention is that it provides a heating means whose consumption can be compensated so that it does not adversely affect the heat balance or economics.

Thus the present invention relates to a method for assisting cold starting of automobiles with internal combustion engines comprising in particular a coolant circuit and an exhaust line having a catalyst and a means for recovering calories produced by said burner such as an exchanger, the calories so recovered being restored to at least one of the following elements: the intake air, the walls of the engine itself, the internal engine cooling circuit, or the passenger compartment heating means.

According to the invention, said method consists of using at least one burner for directly heating a gas-liquid exchanger built into the engine cooling circuit, as well as the engine exhaust gases, so that the intake air and the passenger compartment in particular benefit from the heating of the cooling circuit.

According to the invention, the method is used for a set period of time, essentially when the engine is cold.

In addition, the method according to the invention can be used for a set period of time depending on the speed and load on the engine.

In particular, the burner is supplied with the same fuel as the engine.

The catalyst can be disposed between the burner and the heat exchanger.

Without departing from the framework of the invention, the heat exchanger may be located between the burner and the catalyst.

The present invention also relates to a device for assisting cold starting of automobiles with internal combustion engines, comprising in particular a cooling circuit and an exhaust line having a catalyst.

The device according to the invention has a burner cooperating with calorie recovery means such as an exchanger such that the calories thus recovered are restored to at least one of the following elements: the intake air, the walls of the engine itself, the engine cooling circuit, or the passenger compartment heating means.

According to the invention, the burner is disposed so as to heat directly a gas-liquid exchanger built into the engine cooling circuit and the engine exhaust gases such that the intake air and the vehicle passenger compartment in particular benefit from the heating of the cooling circuit.

Advantageously, the burner is supplied with the same fuel as the engine.

According to one of its characteristics, the burner is made to operate for a set period of time, essentially when the engine is cold.

According to another characteristic, the burner is made to operate for a set period of time depending on the speed and load on the engine.

Other characteristics, advantages, and features of the present invention will emerge from reading the description hereinbelow provided as an illustration and not a limitation, with reference to the single figure attached.

BRIEF DESCRIPTION OF THE FIGURE

This FIGURE shows schematically an internal combustion engine 1 and the associated cooling circuit 7.

DESCRIPTION OF THE INVENTION

In the usual manner, the coolant is made to circulate by a pump 2 through several elements for heat exchange: in addition to the metal mass of engine 1 itself, the water exchanges calories with the oil via an oil-water exchanger 3, with the intake air via an air-water exchanger 11, and with the passenger compartment via a heater 4. The flowrate of water circulating in a radiator 10 and oil-water exchanger 3 is regulated by a thermostat 9.

According to the invention, at least one burner 5 is located in the cooling circuit such that it can heat a gas-liquid exchanger 6 built into cooling circuit 7 of engine 1. Exchanger 6 is disposed in exhaust 8 such that the combustion gases from burner 5 pass through exchanger 6 and are then evacuated with the exhaust gases that they heat. Thus, the combustion gases from burner 5 can be used to heat a catalyst (not numbered) located at exhaust 8. Once the catalyst has been activated, the hot gases are converted thereby.

In other words, some of the heat from the combustion gases of burner 5 is thus captured by the coolant which, through the usual elements in cooling circuit 7, transfers this heat to the oil (via exchanger 3), to the intake air, to the passenger compartment (via heater 4), and to the metal mass of engine 1.

The remainder of the heat from burner 5, having traversed exchanger 6, thus becomes mixed with the exhaust gases from engine 1 as indicated hereinabove.

Without departing from the framework of the present invention, the catalyst (unnumbered) can be placed in front of exchanger 6 built into cooling circuit 7.

Calculation shows that in this way a heat recovery on the order of 10 kW can be expected in cooling circuit 7 of an average automobile engine, which results in the fluid temperature rise time being decreased by a factor of 2 while guaranteeing proper heating of the passenger compartment with an average of 5 kW being available at the heater. This applies to the low-speed low-load starting conditions that are concerned in particular by the problems described above.

The time for which burner 5 operates depends of course on the outside temperature but also on the speed and on the load imposed on engine 1. In all cases, only the first few minutes of starting need be assisted in this manner, and a compromise must be sought in order not to increase overconsumption.

It is usually considered that the engine is cold when the temperature of the cooling circuit is less than approximately 50° C.

One or more temperature sensors are provided for the engine, associated with a burner control element 12, in order to activate the latter once a certain temperature has been exceeded.

Under these conditions, an unchanged consumption balance may be expected, namely the fuel used in the burner may be compensated by the gains in engine efficiency effected by a rapid decrease in friction, resulting from the faster temperature rise of the lubricant and because of the improved fuel/air mix.

The economics of the system improve with decreasing starting temperature as the increase in friction is in a near-exponential relationship with the decrease in temperature.

Thus, the essential advantage of the device resides in the improvement in pollution control effected overall by accelerated heating of all parts of the engine, in particular heating of the intake air for an improved fuel/air mix, and of the exhaust catalyst for more rapid activation. Finally, the passenger compartment can be heated to such a degree that no additional heating means are required.

I claim:

1. Method for cold starting automobiles with internal combustion engines comprising a cooling circuit of the engine including an integrated gas/liquid exchanger in cooperation with a burner and an exhaust line with a catalyst, said method consisting of providing the automobile with at least one burner and a device for recovering the calories produced by said burner, wherein the calories recovered are restored to an internal cooling circuit of the engine; wherein said burner is used to heat the catalyst, and an integrated gas-liquid exchanger in cooperation with said burner built into the internal cooling circuit of the engine, wherein said burner heats exhaust gases from the engine, such that the intake air, engine oil, the walls of the engine and the passenger compartment are heated due to the heating of the internal cooling circuit by heat of combustion gases of the burner captured by the cooling circuit, and wherein the burner is made to operate for a specific period of time depending upon the speed and load on the engine.

2. Method according to claim 1, wherein said method is used for a set period of time, essentially when the engine is cold.

3. Method according to claim 1, wherein said method is used for a set period of time depending on the speed and on the load on the engine.

4. Method according to claim 1, characterized in that burner is supplied with the same fuel as the engine.

5. Method according to claim 1, characterized in that said catalyst is disposed between the burner and the exchanger.

6. Method according to claim 1, characterized in that the exchanger is disposed between said burner and said catalyst.

7. The method of claim 1, wherein said device for recovering the calories produced by said burner is an exchanger.

8. The method of claim 1, wherein said burner directly heats said gas-liquid exchanger built into the cooling circuit.

9. Device for cold starting automobiles with an internal combustion engine including a cooling circuit of the engine and an exhaust line with a catalyst, and including an integrated gas/liquid exchanger in cooperation with a burner, comprising a burner which heats a catalyst and cooperates with a calorie recovery device such that the calories thus recovered are restored to intake air, walls of the engine itself, an engine cooling circuit and a passenger compartment heating means; said burner being located so as to heat the catalyst, an integrated gas-liquid exchanger in cooperation with said burner built into the cooling circuit of the engine, and said burner also heats exhaust gases of the engine, such that the intake air, the walls of the engine and the passenger compartment are heated due to the heating of the internal cooling circuit by heat of combustion gases of the burner captured by the cooling circuit, and wherein the burner is controlled by a burner control element whereby the burner is made to operate for a specific period of time depending upon the speed and load on the engine.

10. Device according to claim 9, characterized in that burner is supplied with the same fuel as the engine.

11. Device according to claim 9, characterized in that the burner is made to operate for a specific period of time, essentially when the engine is cold.

12. The device of claim 9, wherein said calorie recovery device is an exchanger.

13. The device of claim 9, wherein said burner directly heats said gas-liquid exchanger built into the cooling circuit.

14. The device of claim 9, wherein the intake air and the vehicle passenger compartment benefit from the heating of the cooling circuit.

15. Device for cold starting automobiles with an internal combustion engine comprising a burner which heats a catalyst and exhaust gases within an exhaust line and which cooperates with calorie recovery device in said exhaust line, wherein said calorie recovery device transfers heat to a coolant in a cooling circuit, and wherein said cooling circuit transfers heat to oil, to intake air, to a passenger compartment and to a metal mass of the engine; and wherein both said burner and heated exhaust gases simultaneously heat the catalyst, and wherein the burner is controlled by a burner control element whereby said burner is made to operate for a specific period of time depending upon the speed and load on the engine.

16. Method for cold starting automobiles with an internal combustion engine comprising providing an internal combustion engine with a burner which heats a catalyst and exhaust gases within an exhaust line and which cooperates with calorie recovery device in said exhaust line, wherein said calorie recovery device transfers heat to a coolant in a cooling circuit, and wherein said cooling circuit transfers heat to oil, to intake air, to a passenger compartment and to a metal mass of the engine; wherein both said burner and heated exhaust gases simultaneously heat the catalyst, and wherein the burner is made to operate for a specific period of time depending upon the speed and load on the engine.

17. Method for cold starting automobiles with internal combustion engines comprising a cooling circuit for the engine including an integrated gas/liquid exchanger in cooperation with a burner, and an exhaust line with a catalyst, said method consisting of providing the automobile with at least one burner and a device for recovering the calories produced by said burner, wherein the calories recovered are restored to an internal cooling circuit of the engine; wherein said burner is simultaneously used to heat the catalyst, an integrated gas-liquid exchanger built into the internal cooling circuit of the engine and heat the exhaust gases from the engine in cooperation with said burner, such that the intake air, the walls of the engine and the passenger compartment are heated due to the heating of the internal cooling circuit by heat of combustion gases of the burner captured by the cooling circuit, wherein the burner is made to operate for a specific period of time depending upon the speed and load on the engine, and wherein the burner is fueled with the same fuel as the engine.

* * * * *